US005811159A

United States Patent [19]

Chang

[11] Patent Number: 5,811,159

[45] Date of Patent: Sep. 22, 1998

[54] ORNAMENTAL BALL

[75] Inventor: Po-Tseng Chang, Kaohsiung, Taiwan

[73] Assignee: Kuo Jung Lin, Tainan, Taiwan

[21] Appl. No.: 840,811

[22] Filed: Apr. 16, 1997

[51] Int. Cl.[6] ..... A47G 33/08

[52] U.S. Cl. ..... 428/11; 40/661

[58] Field of Search ..... 428/11; 40/661

[56] References Cited

U.S. PATENT DOCUMENTS 3,802,104 4/1974 Wiley ..... 428/11 X 4,173,667 11/1979 Rusch ..... 428/11

4,224,364 9/1980 Hunt ..... 428/11

*Primary Examiner*—Henry F. Epstein

*Attorney, Agent, or Firm*—Bacon & Thomas

[57] ABSTRACT

An ornamental ball includes a spherical body consisting of two semi-spherical half bodies, and an inner ornamental member contained in the ball. The inner ornamental member is fixed inside the ball, having an axis shorter than the diameter of the ball and having two ends of the axis fixed at non-diametrical locations of an inner surface of the ball. Consequently, the ball rotates irregularly owning to the gravitational impact of the ornamental member.

7 Claims, 5 Drawing Sheets

ORNAMENTAL BALL

BACKGROUND OF THE INVENTION

This invention relates to an ornamental ball, particularly to a ball containing an inner ornamental member in its interior fixed in a non-diametrical location of the ball so that the ball may rotate irregularly owing to the gravitational impact of the ornamental member.

Common conventional ornamental balls have a hollow or solid interior, and an outer surface with colors or pictures, presenting stationary beauty. They are widely used in key rings, hair bands, pen caps, bracelets, etc.

However, conventional ornamental balls have monotonous designs of little variation, with not much interest to intrigue people.

SUMMARY OF THE INVENTION

The purpose of the invention is to offer an ornamental ball containing an inner ornamental member to let the ball rotate irregularly.

A main feature of the invention is an inner ornamental member fixed in a non-diametrical axis of the ball, i.e. the axis of the ornamental member is shorter than the diameter of the ball.

BRIEF DESCRIPTION OF DRAWINGS

This invention will be better understood by referring to the accompanying drawings, wherein.

DESCRIPTION OF THE PREFERRED EMBODIMENT

Figure 1:
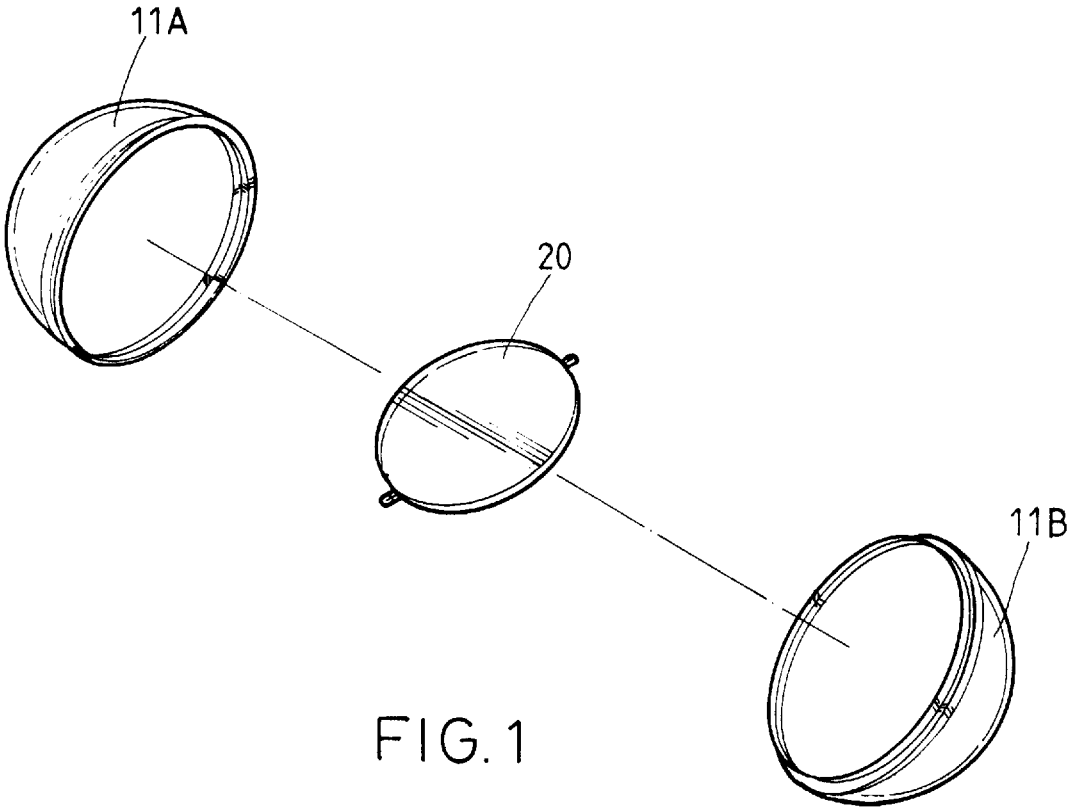
FIG. 1 is an exploded perspective view of an ornamental ball of the present invention.
Figure 2:
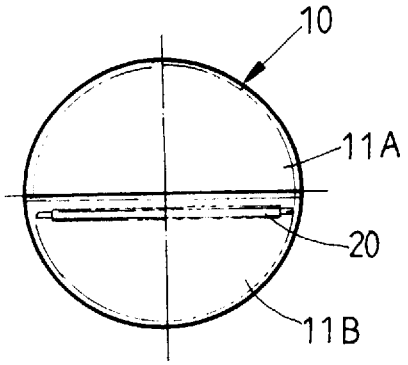
FIG. 2 is a front view of the ornamental ball of the present invention illustrated in FIG. 1.

A first preferred embodiment of an ornamental ball in the present invention, as shown in FIGS. 1 and 2, includes a left semi-spherical body 11A and a right semi-spherical body 11B combined together by means of screws, fitting, adhesion, or any other method to form a spherical ball 10.

Figure 4:
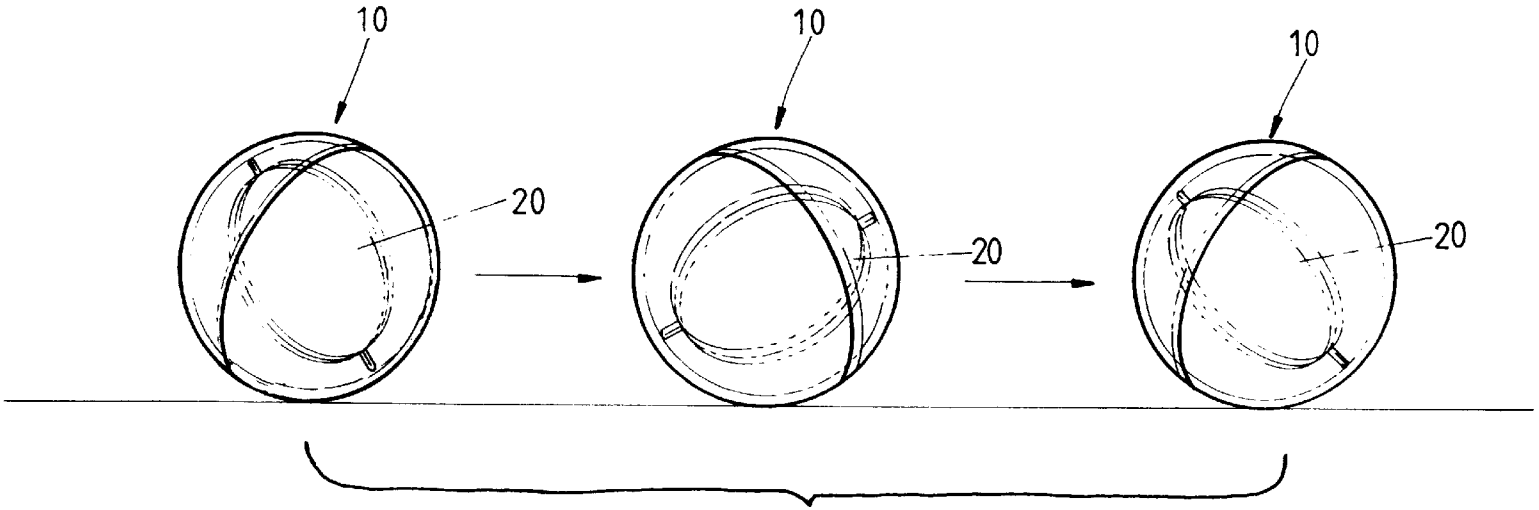
FIG. 4 is a sequential schematic view of the first preferred embodiment of an ornamental ball in the present invention, showing it in moving condition.
Figure 3:
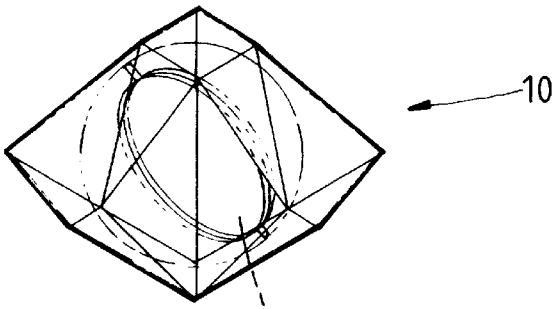
FIG. 3 is a perspective view of another preferred embodiment of an ornamental ball of the present invention.

Further, an inner ornamental member 20 is contained in the ball 10. The ball 10 does not necessarily have a spherical shape, but may be shaped rhombic, oval, etc. so long as it has an ornamental effect and the inner ornamental member can be seen from outside. Besides, the inner ornamental member 20 naturally has some weight, having an axis with two ends fixed non-diametrically with an inner surface of the ball 10, as shown in FIG. 2. Consequently, if the ball 10 is rotated, as shown in FIG. 4, it will move to search for an equilibrium, with the axis of the inner ornamental member 20 functioning as an axis so that the ball 10 rotates irregularly, not based on the diametrical axis, moving with a variety of indefinite rolling for onlookers to enjoy as a delight.

Figure 5:
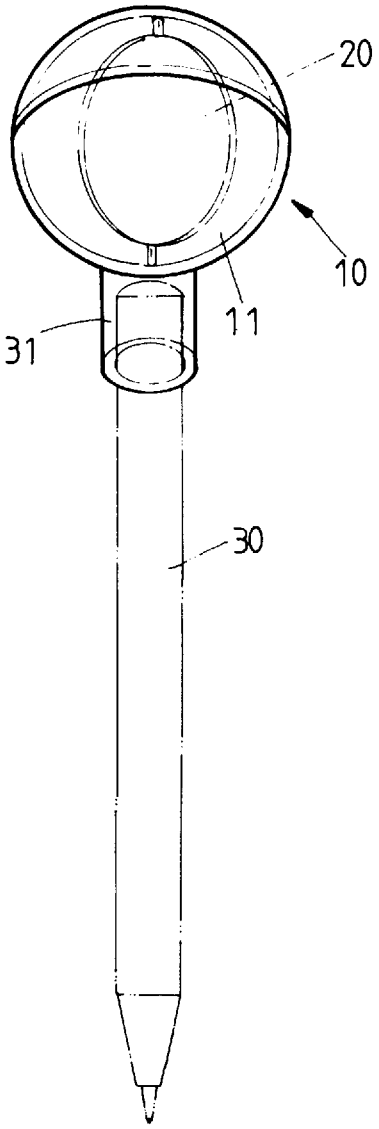
Figure 5 is a front view of an ornamental ball of the present invention, having a tubular pen cap fitted around the top of a ballpoint pen.
Figure 6:
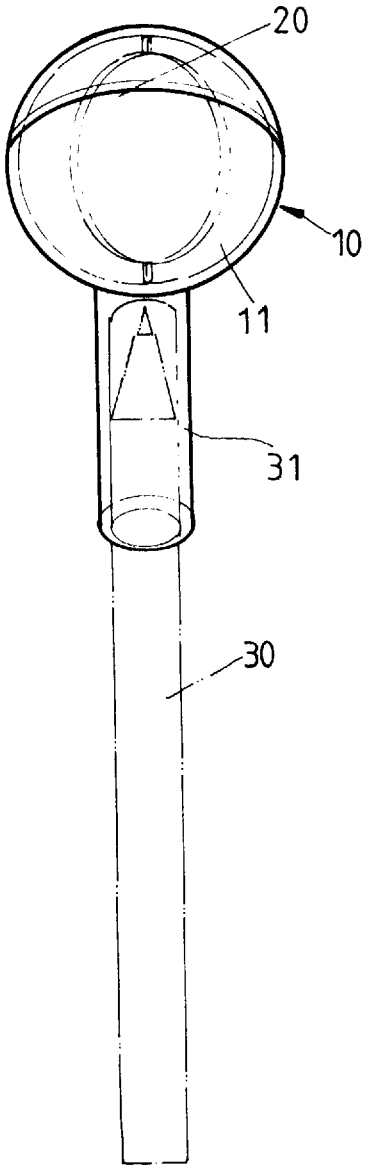
FIG. 6 is a front view of an ornamental ball of the present invention, having a tubular pen cap fitted around the lower end of a ballpoint pen.

FIGS. 5 and 6 show another use for the ornamental ball of the invention, provided with a tubular pen cap 31 formed integral with the left or the right semi-spherical body 11. Then the pen cap 31 can be fitted around the top end or the lower end of a ballpoint pen 30. Then the ballpoint pen 30 has a function for writing and for an ornament as well.

Figure 7:
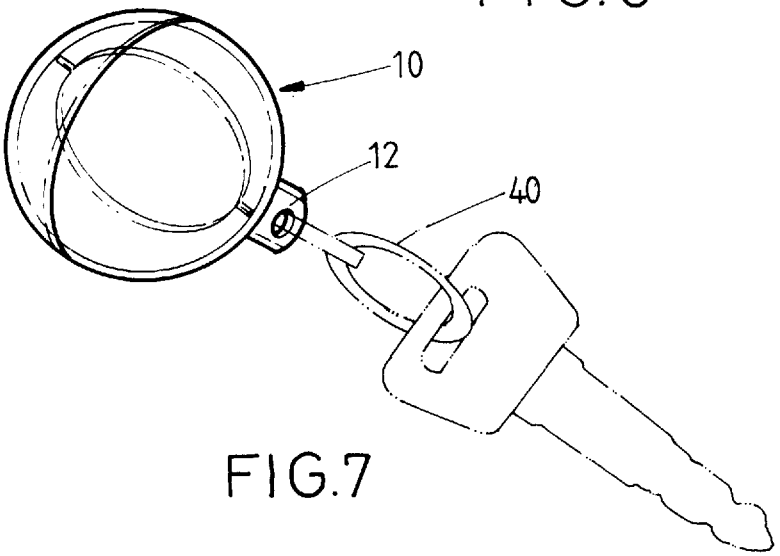
FIG. 7 is a perspective view of an ornamental ball of the present invention, attached to a key ring.

Further, FIG. 7 shows an alternative use for the ornamental ball of the present invention, having a projecting ear 12 with a hole for a ring to connect it with a key ring 40.

Figure 8:
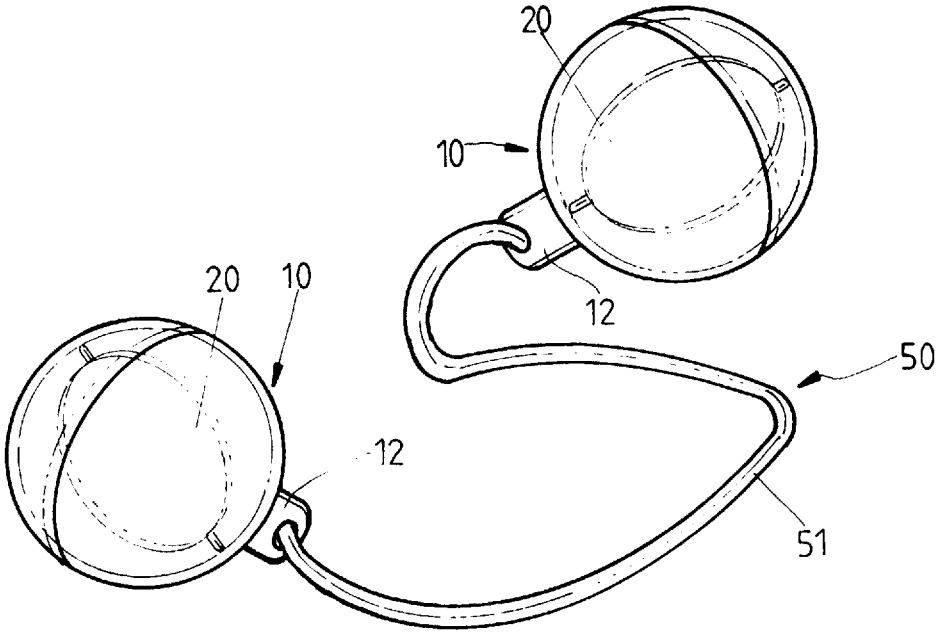
FIG. 8 is a perspective view of an ornamental ball of the present invention, combined with a hair band; and, FIG. 9 is a sequential schematic view of an ornamental ball of the present invention, showing it in moving condition.

Further, FIG. 8 shows that the present invention can be used combined with a hair band 51, forming a hair ornament 50, with two ends of the hair band 51 bound with the ears 12, 12 of two of the ornamental balls 10. Then the ornamental members 20, 20 move to act as visual attractions.

Figure 9:
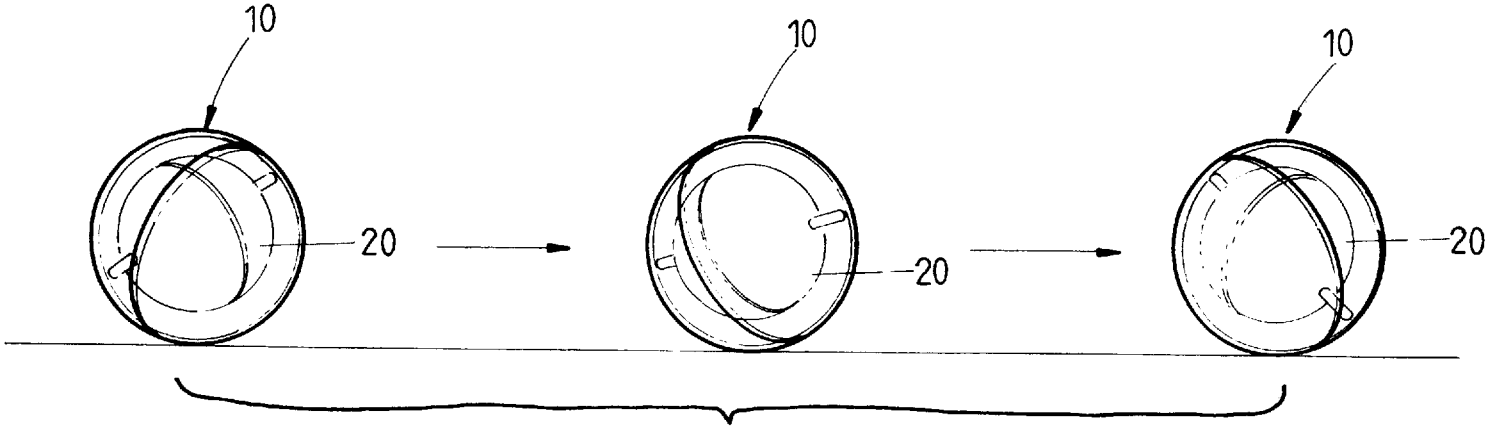

As to the shape of the ornamental member 20, it is not limited to the illustrations in the drawings, and is possible to have any shape, so long as it may attract attention. But there is one fundamental condition that the axis connecting the two ends of the ornamental member is shorter than the diameter of the ball 10. FIG. 9 shows an alternative preferred embodiment of an ornamental ball, which has an inner ornamental member 20 formed as a spherical ball as the ball 10, with its diameter being shorter than the diameter of the ball 10. In this preferred embodiment, the inner spherical ornamental member 20 can have another inner ornament in its interior so as to produce double effects.

While the preferred embodiments of the invention have been described above, it will be recognized and understood that various modifications may be made therein and the appended claims are intended to cover all such modifications which may fall within the spirit and scope of the invention.

I claim:

1. An ornamental device comprising:

a) an ornamental body having an inner surface bounding a hollow interior and comprising first and second body portions joined together along a joining plane passing through a portion of the ornamental body having a maximum transverse dimension and a center of the ornamental body; and b) an ornamental member having two oppositely facing mounting protrusions with a dimension between extremities of the mounting protrusions less than the maximum transverse dimension of the ornamental body, the ornamental member being affixed to the inner surface of the ornamental body at the two mounting protrusion such that an axis passing through the two mounting protrusions is displaced from the joining plane of the ornamental body.

2. The ornamental device of claim 1 wherein the ornamental body has a spherical configuration.

3. The ornamental device of claim 2 wherein each of the first and second body portions have a hemispherical configuration.

4. The ornamental device of claim 1 wherein the ornamental member has a circular configuration.

5. The ornamental device of claim 1 wherein the ornamental member has a spherical configuration.

6. The ornamental device of claim 1 wherein the ornamental body further comprises a tubular pen cap extending outwardly therefrom.

7. The ornamental device of claim 1 wherein the ornamental body further comprises a projecting ear extending therefrom, the projecting ear having at least one hole therethrough.

* * * * *